US006838649B2

(12) United States Patent
Lee

(10) Patent No.: US 6,838,649 B2
(45) Date of Patent: Jan. 4, 2005

(54) COMMERCIAL MICROWAVE OVEN

(75) Inventor: Dong Heon Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/716,528

(22) Filed: Nov. 20, 2003

(65) Prior Publication Data

US 2004/0149751 A1 Aug. 5, 2004

(30) Foreign Application Priority Data

Dec. 26, 2002 (KR) ..... P10-2002-0084112

(51) Int. Cl.[7] ..... H05B 6/70
(52) U.S. Cl. ..... 219/757; 219/746; 126/21 A
(58) Field of Search ..... 219/757, 681, 219/746–751; 126/21 A, 299 R

(56) References Cited

U.S. PATENT DOCUMENTS 4,184,945 A * 1/1980 Morgan et al. ..... 219/757
5,945,024 A * 8/1999 Fukunaga et al. ..... 219/757
6,150,648 A * 11/2000 Kang et al. ..... 219/757

* cited by examiner

*Primary Examiner*—Philip H. Leung
(74) *Attorney, Agent, or Firm*—Fleshner & Kim LLP

(57) ABSTRACT

Commercial microwave oven including a main cabinet for enclosing and protecting various components, having air inlet holes, a base frame under the main cabinet having a box form with an opened top and a front part with a plurality of air outlet holes, a bottom plate on the base frame, an inner case in a space above one side part of the bottom plate, the inner case having a cooking chamber formed therein, a magnetron on a lower part of an outside of the inner case, a transformer for regulating a voltage provided to the magnetron, a waveguide on an underside of the bottom plate, a fan in a rear of outside of the inner case, and a flow guide for guiding air passed through the magnetron toward air outlet holes, thereby cooling components effectively, reducing a volume, and cost of the product.

10 Claims, 8 Drawing Sheets

COMMERCIAL MICROWAVE OVEN

This application claims the benefit of the Korean Application No. P20020084112 filed on Dec. 26, 2002, which is hereby incorporated by reference.

BACKGROUND OF THE INVENTION

1. Field of the Invention

The present invention relates to microwave ovens, and more particularly, to a commercial microwave oven which can dissipate heat from components, effectively.

2. Background of the Related Art

In general, the microwave oven (MWO) cooks food with heat from friction between molecules caused by disturbance of the molecular arrangement of the food made with a microwave (approx. 2,450 MHz). The microwave oven may have one or a plurality of magnetrons.

Microwave oven with one magnetron is employed as domestic use where the microwave oven is not used frequently, and microwave oven with a plurality of magnetrons is employed as commercial use for convenience store and the like where high power is required continuously.

FIGS. 1~3 illustrate inside structures of related art commercial microwave ovens, schematically.

Referring to FIG. 1, the related art commercial microwave oven is provided with an outer case 11, a base plate 12, an inner case 13, a front panel 14, a rear panel 15, one pair of magnetrons, transformers, and an outfit chamber. An inside space of the inner case is a cooking chamber. The outfit chamber is one side space of an inside space of the microwave oven excluding a part occupied by the inner case, where different components are provided.

During operation of the microwave oven, the magnetrons 17*a* and 17*b* and the transformers 16*a* and 16*b* generate much heat. Particularly, when the microwave oven is used in a convenience store or the like, it is liable that the magnetrons 17*a* and 17*b* are overheated and damaged due to continued use. Therefore, a structure that can cool down the magnetrons 17*a* and 17*b* and the transformers 16*a* and 16*b* adequately is required.

Referring to FIG. 1, the base plate 12 has a plurality of inlet holes 12*a* in a front surface for drawing external air, and the rear panel 15 has outlet holes 15*a* for exhaust of air. FIGS. 2 and 3 illustrate a side view and a rear view of the related art microwave oven, respectively.

Referring to FIGS. 2 and 3, the one pair of transformers 16*a* and 16*b* are mounted on one side of the outfit chamber, and the magnetrons 17*a* and 17*b* are mounted on a top and a bottom of a rear part of the inner case 13.

The location of the one pair of the magnetrons 17*a* and 17*b* far from each other requires a complicated air supply structure for the fan 18*a* to blow the external air thereto.

That is, a duct 19 is provided for making an air outlet of the fan and the magnetrons 17*a* and 17*b* are in communication. Moreover, a centrifugal fan is employed as the fan for drawing external air and blowing the air in a direction perpendicular to an air draw direction. Thus, the external air passes through the fan 18*a*, flows along the duct 19, and cools the magnetrons 17*a* and 17*b*. Then, the air exhausts through the outlet holes 15*a* in the rear panel 15.

However, the related art microwave oven has the following problems.

First, the occupation of a rear space by the plurality of magnetrons and the duct causes a volume of a rear part of the microwave oven large.

Second, the centrifugal fan as well as the blower motor on the centrifugal fan are expensive.

SUMMARY OF THE INVENTION

Accordingly, the present invention is directed to a commercial microwave oven that substantially obviates one or more of the problems due to limitations and disadvantages of the related art.

An object of the present invention is to provide a commercial microwave oven which has a reduced overall volume while a size of a cooking chamber is kept the same.

Another object of the present invention is to provide a commercial microwave oven which can reduce a production cost.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the commercial microwave oven including a main cabinet for enclosing and protecting various components, having air inlet holes, a base frame under the main cabinet having a box form with an opened top and a front part with a plurality of air outlet holes, a bottom plate on the base frame, an inner case in a space above one side part of the bottom plate, the inner case having a cooking chamber formed therein, a magnetron on a lower part of an outside of the inner case, a transformer for regulating a voltage provided to the magnetron, a waveguide on an underside of the bottom plate, a fan in a rear of outside of the inner case, and a flow guide for guiding air passed through the magnetron toward air outlet holes.

The bottom plate has an opening adjacent to the air outlet holes.

The flow guide is provided between the magnetron and the air outlet holes. The flow guide is formed of a thin plate having a lower part the more bent forward with a slope as it goes down the farther.

The main cabinet includes an outer case forming a top and sides of the microwave oven, a front panel on a front part of the outer case, and a rear panel on a rear part of the outer case having air inlets. The waveguide has one end in communication with a bottom of the inner case, and the other end in communication with the magnetron.

The commercial microwave oven further includes a supporting frame having a bottom part fixed to the base frame, and a top part the transformer is mounted thereon. The fan has a central part mounted at a height in the middle of a height of the magnetron and a height of the transformer.

For introduction of air into the cooking chamber, the inner case has inlet holes in a side surface adjacent to the magnetron. The fan is an axial fan.

In another aspect of the present invention, there is provided a commercial microwave oven including a main cabinet for enclosing and protecting various components, having air inlet holes, a base frame under the main cabinet having a box form with an opened top and a front part with a plurality of air outlet holes, a bottom plate on the base frame, an inner case in a space above one side part of the bottom plate, the inner case having a cooking chamber formed therein, a magnetron on an upper part of an outside of the inner case, a transformer for regulating a voltage provided to the magnetron, a waveguide on a top of the inner case, a fan in a rear of outside of the inner case, and a flow guide for guiding air passed through the magnetron toward air outlet holes.

In further aspect of the present invention, there is provided a commercial microwave oven including a main cabinet for enclosing and protecting various components, having air inlet holes, a base frame under the main cabinet having a box form with an opened top and a front part with a plurality of air outlet holes, a bottom plate on the base frame, an inner case in a space above one side part of the bottom plate, the inner case having a cooking chamber formed therein, a first magnetron on an upper part of an outside of the inner case, and a second magnetron on a lower part of an outside of the inner case, a transformer for regulating a voltage provided to the magnetrons, a first waveguide on a top of the inner case, and a second waveguide on an underside of the inner case, a fan in a rear of outside of the inner case, and a flow guide for guiding air passed through the magnetrons toward air outlet holes.

The first waveguide has one end in communication with a bottom of the inner case, and the other end in communication with the first magnetron, and the second waveguide has one end in communication with a top of the inner case, and the other end in communication with the second magnetron.

The transformer is provided as one pair so as to be connected to respective magnetrons in side by side opposite to the fan for effective heat dissipation.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Different from the related art, the commercial microwave oven of the present invention employs single magnetron. That is, as performance of the magnetron is improved, application of a single magnetron even to the commercial microwave oven is made possible. According to this, the present invention suggests an effective ventilating system for preventing overheating of the single magnetron caused by continued operation thereof.

Embodiments of the ventilating system of the commercial microwave oven of the present invention will be described with reference to FIGS. 4 to 7.

Figure 1:
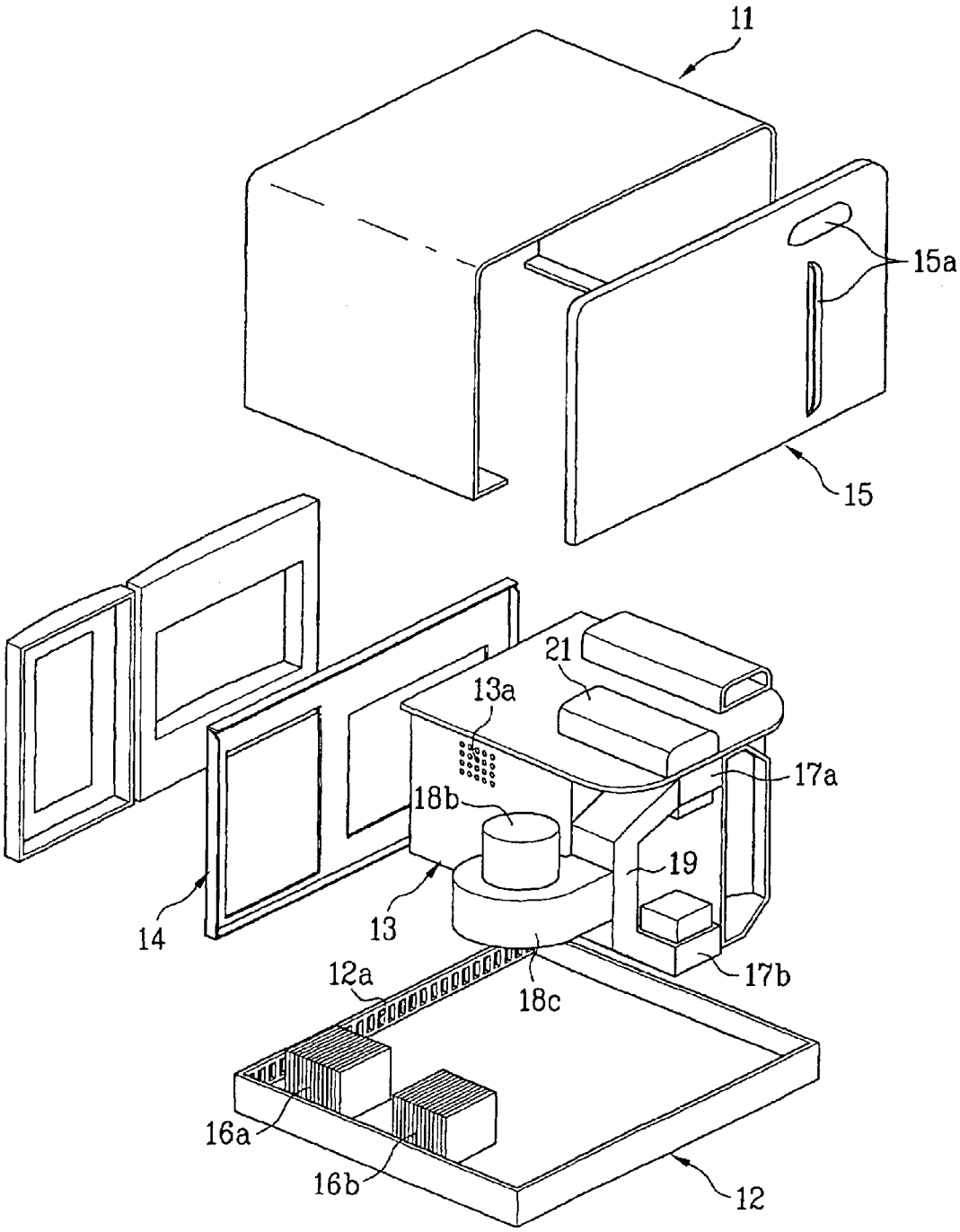
FIG.1 Related Art
FIG. 1 illustrates a disassembled perspective view of a related art microwave oven, schematically.
Figure 2:
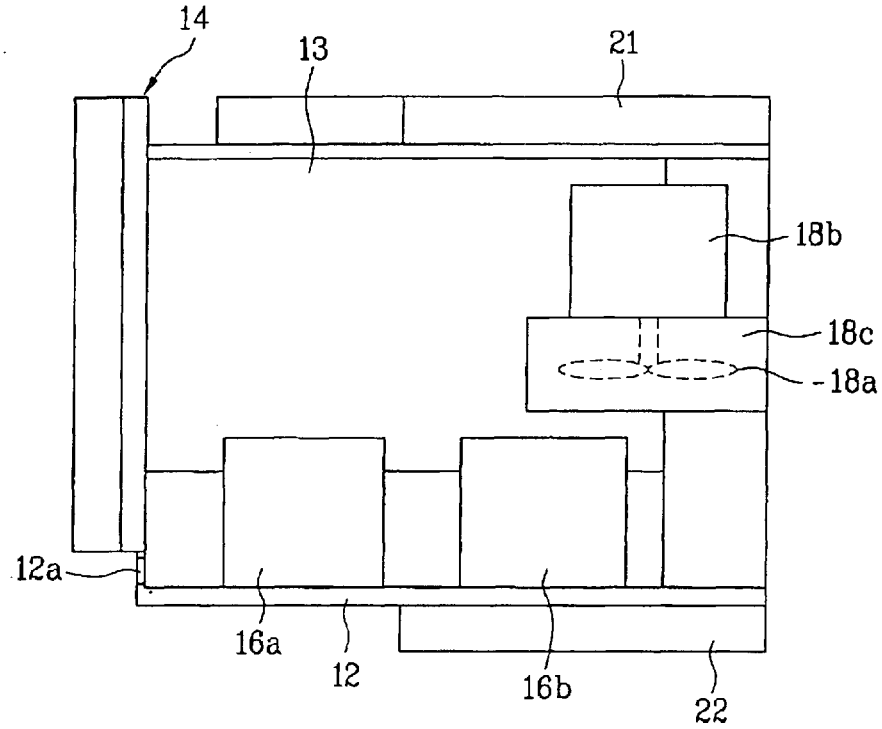
FIG. 2 Related Art
FIG. 2 illustrates a side view of an inside of a related art microwave oven.
Figure 3:
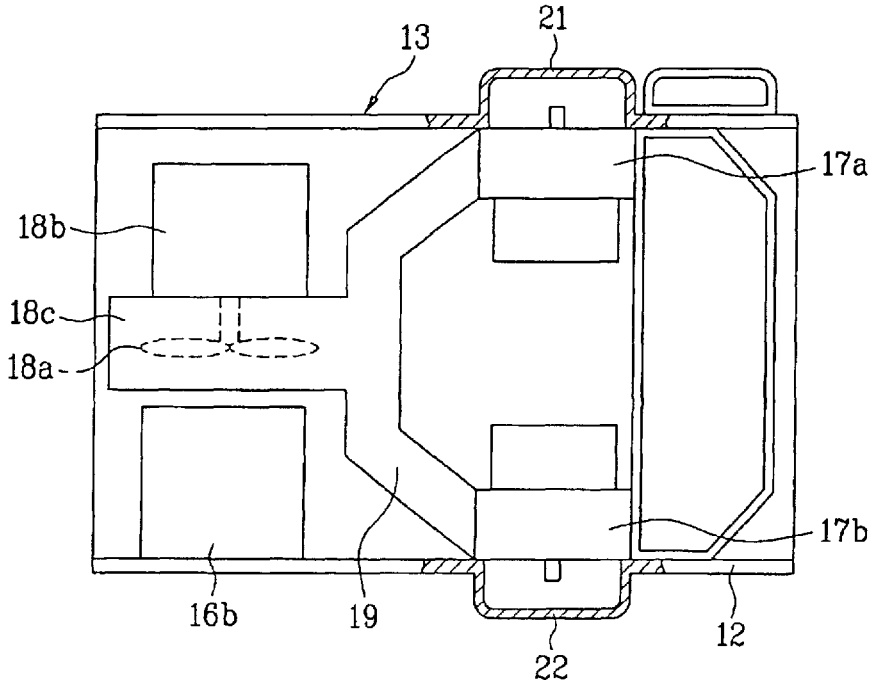
FIG. 3 Related Art
FIG. 3 illustrates a back view of an inside of a related art microwave oven.
Figure 4:
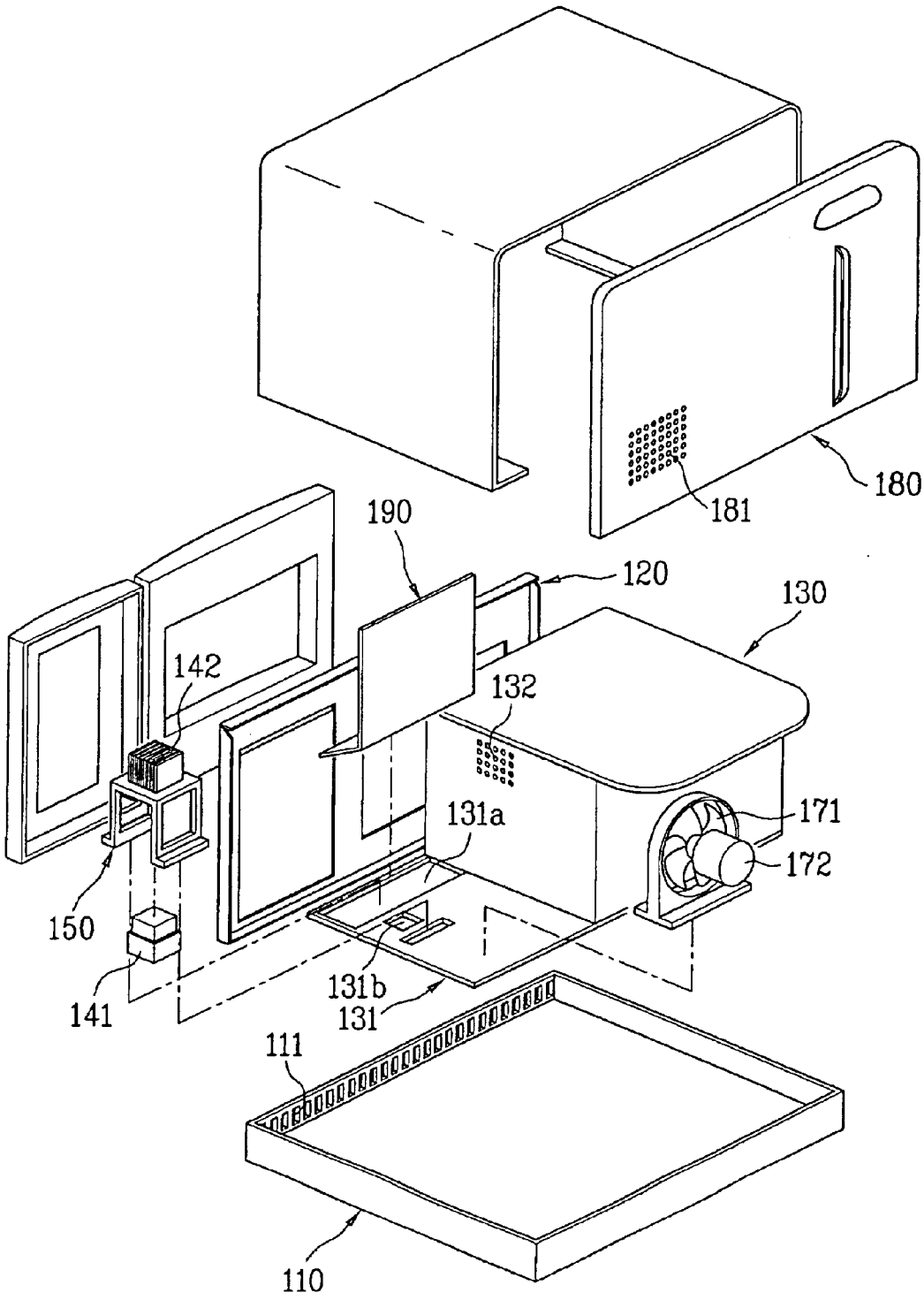
FIG. 4 illustrates a disassembled perspective view of a microwave oven in accordance with a first preferred embodiment of the present invention, schematically.
Figure 5:
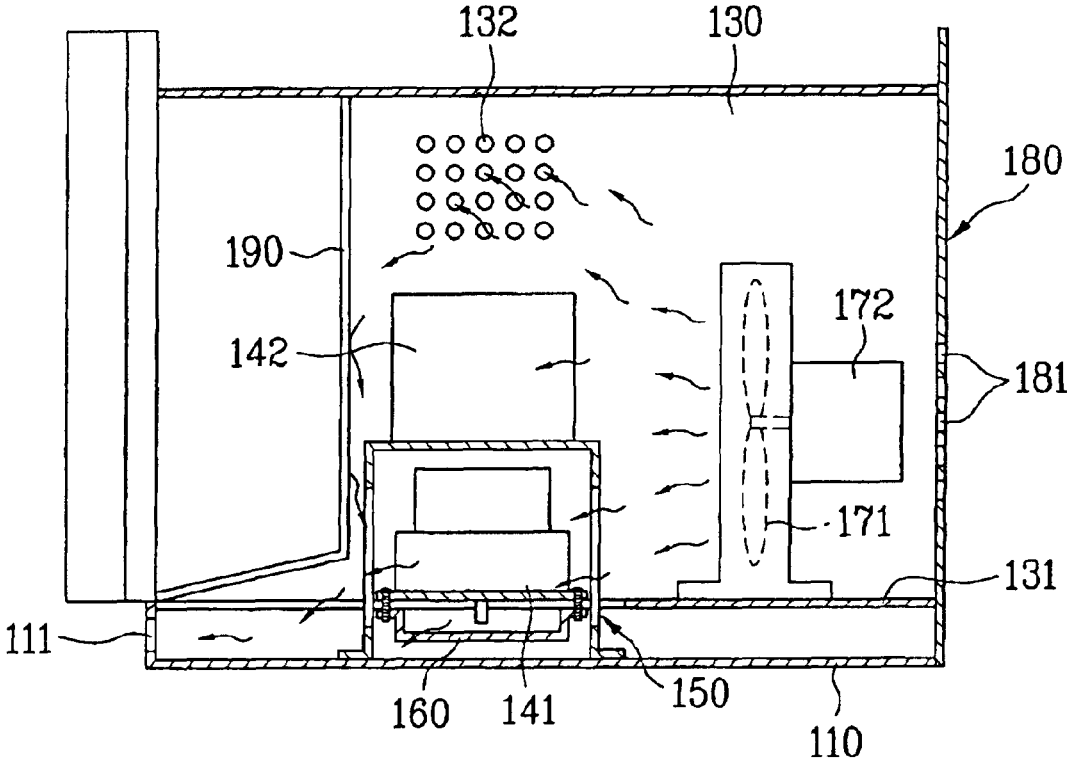
FIG. 5 illustrates a side view of an inside of a microwave oven in accordance with a first preferred embodiment of the present invention.

Referring to FIGS. 4 and 5, the first embodiment commercial microwave oven includes a main cabinet 100, a base frame 110, a bottom plate 131, an inner case 130, a magnetron 141, a transformer 142, a waveguide 160, a fan 171, and a flow guide 190.

Referring to FIG. 4, the main cabinet 100 forms an outer shape of the microwave oven, and encloses and protects various components. The main cabinet 100 has an outer case 101, a front panel 120, and a rear panel 180. The outer case 101 forms a top and sides of the microwave oven. The front panel 120 is mounted on a front part of the outer case 101, and the rear panel 180 is mounted to a rear part of the outer case 101. There are door and the like in front of the front panel 120.

The base frame 110 forms a bottom of the microwave oven, and has a box form with an opened top and a front part with a plurality of air outlet holes 111. The bottom plate 131 is mounted on the base frame 110, on a side part of which the inner case 130 is mounted.

The bottom plate 131 has an opening 131*a* in the vicinity of the air outlet holes 111. The opening 131*a* leads the air from the fan 171 to the air outlet holes 111.

The inner case 130 forms a cooking chamber therein, and outer case of which is used as an outfit chamber for different components. That is, a space in the main cabinet 100, excluding the space of the inner case 130, is the outfit chamber. Also, there are inlet holes 132 in one side of the inner case 130 for making the cooking chamber and the outfit chamber in communication.

It is preferable that the magnetron 141 and the transformer 142 are mounted on a side of the inner case 130 on a central part of the bottom plate 131 extended to the outfit chamber. The magnetron 141 is mounted on the bottom plate 131, and an opening is made in the bottom plate 131 under a part of the magnetron having a microwave generating part located thereon.

The transformer 142 is positioned in a space over the magnetron 141, fixed on a supporting frame 150 over the magnetron 141. The supporting frame 150 mounted on the bottom plate 130 so as to be projected upward, and divide mounting spaces of the transformer 142 and the magnetron 141. Also, as shown, it is preferable that the supporting frame 150 is mounted such that the air flow is not interfered.

The waveguide 160 is mounted in a space between the bottom plate 131 and the base frame 110 along a bottom of the bottom plate 131. The waveguide 160 has one end in communication with an inside of the inner case 130, and the other end in communication with the microwave generating part of the magnetron 141 at the opened part 131*b* of the bottom plate 131. The waveguide 160 transmits the microwave from the magnetron 141 to the cooking chamber in the inner case 130.

The fan 171 is mounted on the bottom part 131 in rear of the outfit chamber, for blowing air toward the space the magnetron 141 and the transformer 142 are provided therein. The rear panel 180 has air inlets 181 adjacent to the fan 171 for drawing air when the fan 171 is driven.

A central part of the fan 171 is positioned at a height of the supporting frame 150 substantially, for uniform flow of the blown air to the magnetron 141 and the transformer 142. The fan 117 is of an axial type.

This is because cooling of the magnetron 141 and the transformer 142 is made adequate even if the air is blown in a horizontal direction by the axial fan, by numbers and positions of the magnetrons 141 and the transformers 142 are simplified. Moreover, by employing not a centrifugal type, but an axial type, for the fan 117, together with a fan motor 172 that drives an axial fan, production cost can be reduced.

In the meantime, the flow guide 190 between the magnetron 141 and the air outlet holes 111 guides air flow, and divides an inside space of the outfit chamber. The flow guide 190 has a lower part the more bent forward with a slope as it goes down the farther for guiding the air passed through the magnetron 141 and the transformer 142 toward the air outlet holes 111 in a front part of the base frame 110.

An air flow in the commercial microwave oven in accordance with a preferred embodiment of the present invention will be described in detail, with reference to FIGS. 4 and 5.

Upon putting the microwave oven into operation, the fan motor 172 is driven, to rotate the fan 171. As the fan 171 rotates, external air is drawn through the air inlets 181 in the rear panel 180. The air passes through the fan 171 and cools down the magnetron 141 and the transformer 142 in front of the fan 171.

In this instance, the air flow is divided into an upper part flow and a lower part flow with reference to the supporting frame 150. The upper part flow flowing through an upper part of the supporting frame 150 cools down the transformer 142, and a portion of which is introduced into the cooking chamber through the inlet holes 132 in one side of the inner case 130. The other portion of the air, passed through the transformer 142, is guided by the flow guide 190 toward a lower space and joins with the lower part flow having flowed through a space under the supporting frame and cooled the magnetron 141.

Thereafter, the air joined thus is guided by the flow guide 190 toward, and passes through the opening 131*a* in a front part of the bottom plate 131, and exhausts to an outside of the microwave oven through the air outlet holes 111 in the front part of the base frame 110.

In the meantime, the commercial microwave oven of the present invention can not but have a system in which the microwave is provided to the cooking chamber through the bottom of the inner case 130, not necessarily.

Figure 6:
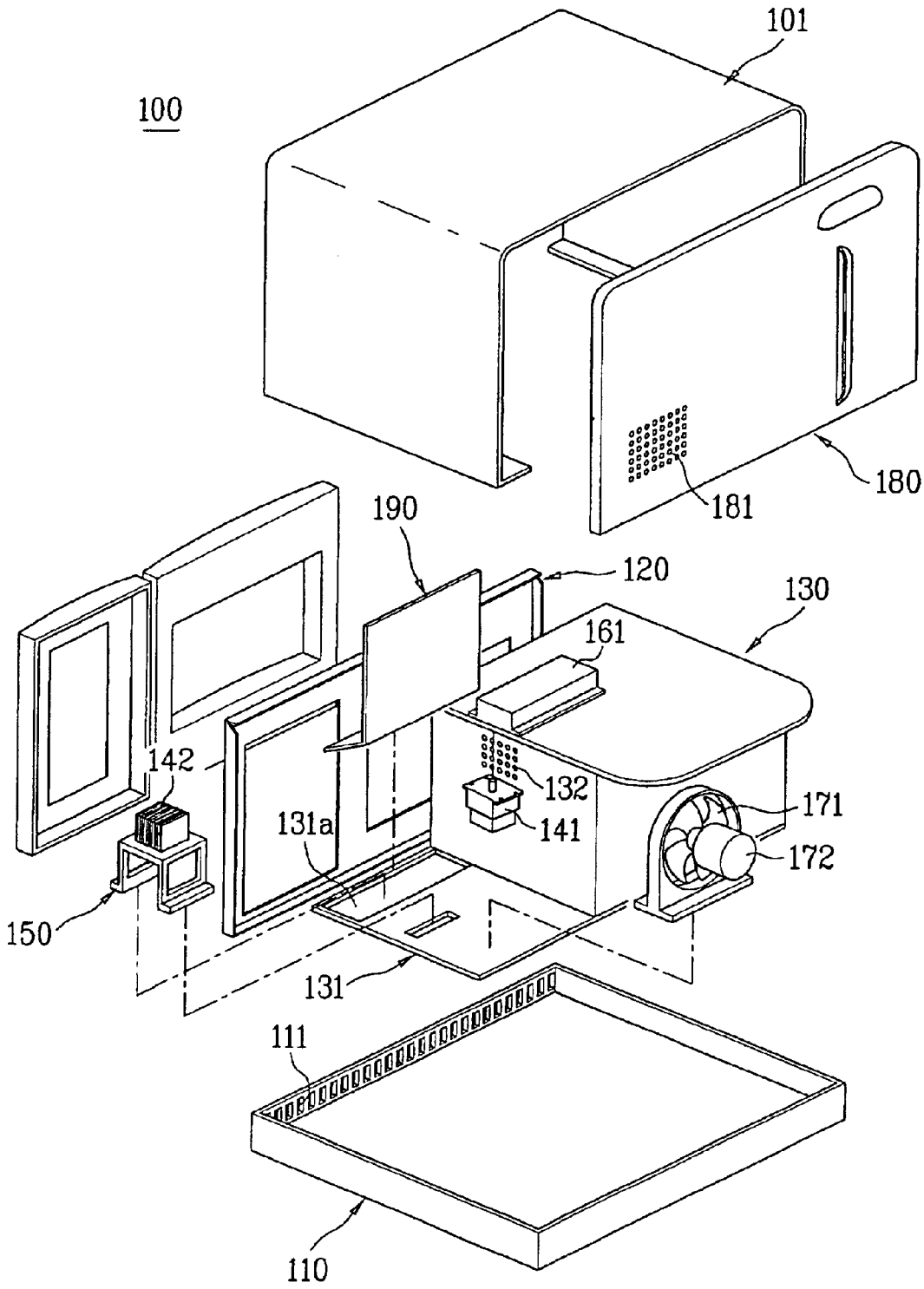
FIG. 6 illustrates a disassembled perspective view of a microwave oven in accordance with a second preferred embodiment of the present invention, schematically.
Figure 7:
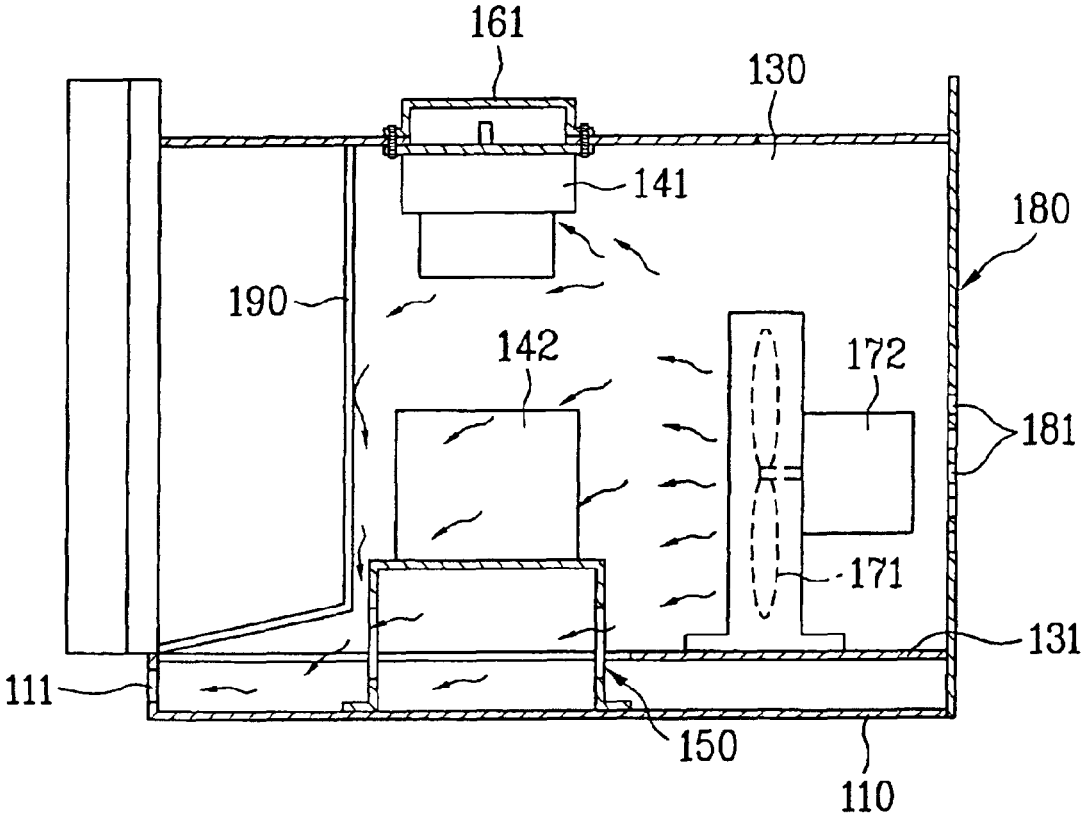
FIG. 7 illustrates a side view of an inside of a microwave oven in accordance with a second preferred embodiment of the present invention.

Referring to FIGS. 6 and 7, a commercial microwave oven in accordance with a second preferred embodiment of the present invention has a waveguide 161 mounted on a top surface of the inner case 130. A magnetron is mounted on an upper part of outside surface of the inner case.

In this instance, a microwave generating part of the magnetron 141 is in communication with one end of the waveguide 161 on the top surface of the inner case 130. A transformer 142 is provided in the outfit chamber. The transformer 142 mounted on a supporting frame 150 and positioned in a space over bottom plate 131. According to this, a center of a fan 171 is positioned at a height in the middle of the heights of the magnetron 141 and the transformer 142.

In the meantime, a commercial microwave oven in accordance with a third preferred embodiment of the present invention has two magnetrons provided to an upper part and a lower part of the outfit chamber on a side of the inner case.

Figure 8:
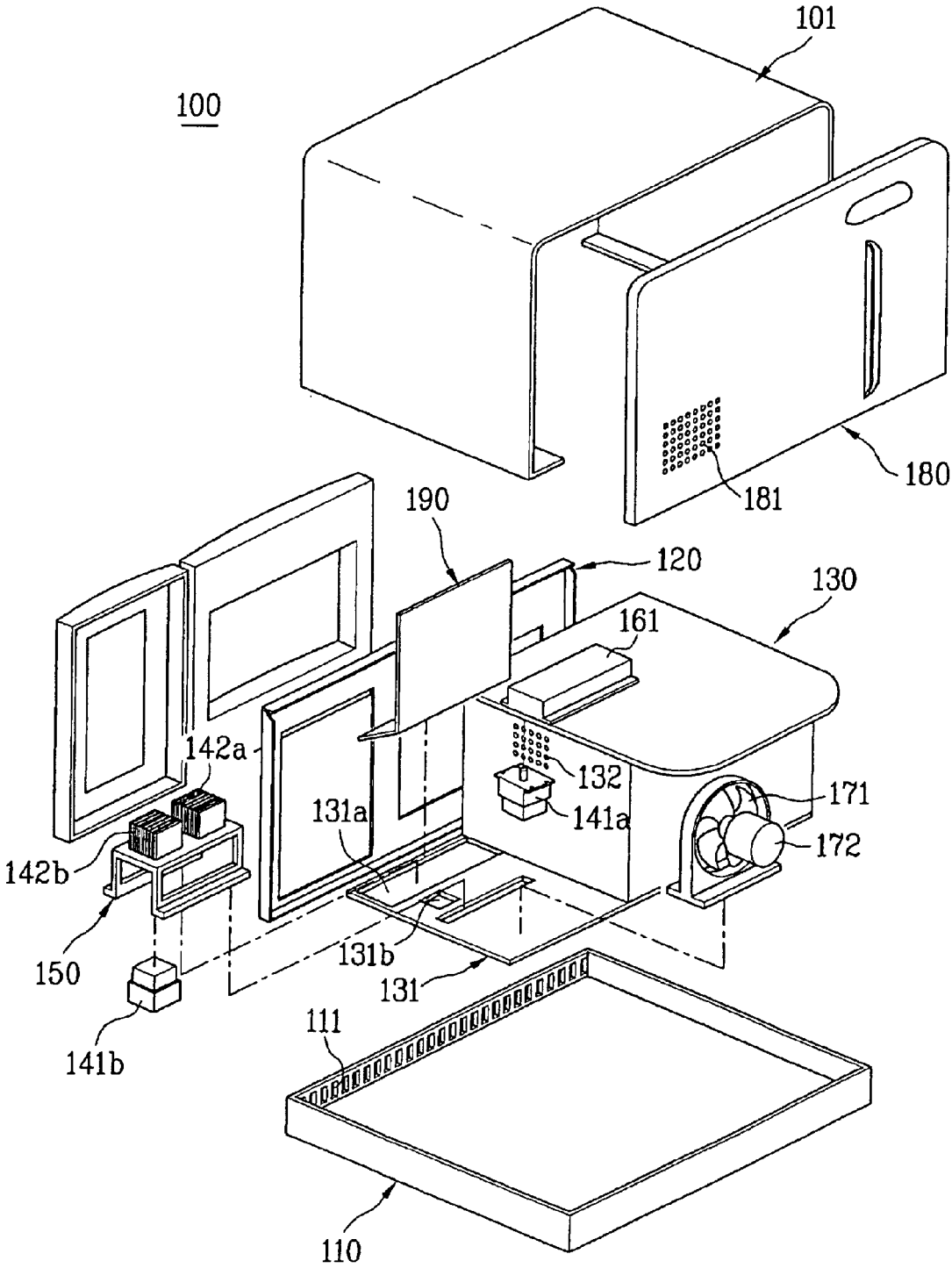
FIG. 8 illustrates a disassembled perspective view of a microwave oven in accordance with a third preferred embodiment of the present invention, schematically.
Figure 9:
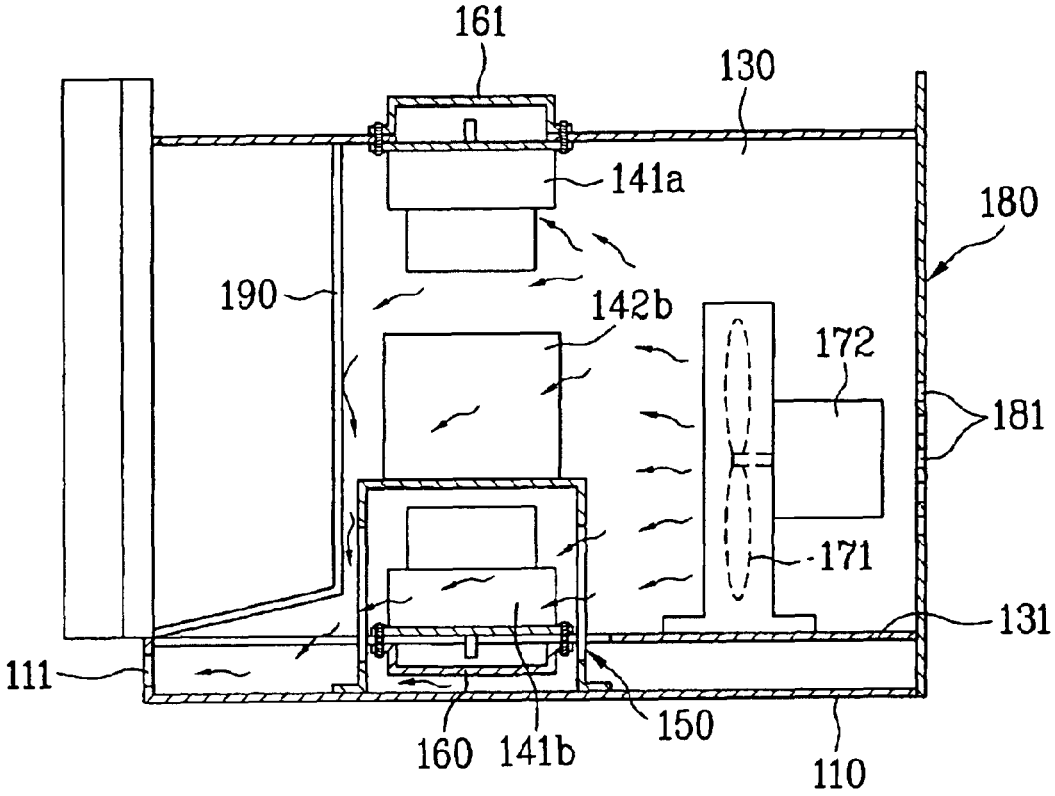
FIG. 9 illustrates a side view of an inside of a microwave oven in accordance with a third preferred embodiment of the present invention.

Referring to FIGS. 8 and 9, the commercial microwave oven in accordance with a third preferred embodiment of the present invention has one pair of magnetrons 141*a* and 141*b*. That is, two magnetrons are provided to an upper part and a lower part of the outfit chamber on a side of the inner case, for providing the microwaves through a top surface and a bottom surface of the inner case 130. To do this, a first waveguide 161 is mounted on the top surface of the inner case 130, and a second waveguide 160 is mounted on an underside of the bottom plate 131 extended from the outfit chamber to the bottom of the inner case 130.

The first magnetron 141*a* is mounted in an upper part of an outside of the inner case 130, and the second magnetron 141*b* is mounted in a lower part of outside of the inner case 130. One end of the first waveguide 161 is in communication with the first magnetron 141*a*, and the second waveguide 160 is in communication with the second magnetron 141*b*. Accordingly, the waves generated from the magnetrons are provided to the top and bottom of the inner case 130 at the same time, thereby increasing an output and providing microwaves from top and bottom uniformly.

For regulating a voltage supplied to the one pair of magnetrons 141*a* and 141*b*, one pair of transformers 142*a* and 142*b* are provided, and the transformers are mounted on top of the supporting frame 150.

The transformers 142*a* and 142*b* and the magnetrons 141*a* and 141*b* are cooled down by external air blown from the fan 171 in rear of the outfit chamber. As shown in FIG. 8, for better cooling of the transformers 142*a* and 142*b*, it is preferable that the transformers 141*a* and 142*b* are mounted side by side at a position opposite to the fan 171.

Thus, according to the second and third embodiments of the present invention, a position of microwave transmission to the cooking chamber and a number of the magnetrons may be varied, as well as an effective air flow system can be provided, thereby permitting to cope with different product requirements. Meanwhile, systems of the main cabinet, the inner case and the like in the second or third embodiments are the same with the first embodiment.

As has been described, the commercial microwave oven of the present invention has the following advantages.

First, by providing a commercial microwave oven having one magnetron and one transformer, to simplify a heat dissipation structure, a productivity of microwave oven production can be improved. The employment of inexpensive axial fan and motor instead of the expansive centrifugal fan and blower motor reduces a production cost.

Second, the simplified ventilating system reduces an overall volume of the microwave oven, thereby permitting to install the microwave oven even in a small space.

Third, the flow guide permits to provide an effective heat dissipation system.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A commercial microwave oven comprising:

a main cabinet for enclosing and protecting various components, having air inlet holes;

a base frame under the main cabinet having a box form with an opened top and a front part with a plurality of air outlet holes;

a bottom plate on the base frame;

an inner case in a space above one side part of the bottom plate, the inner case having a cooking chamber formed therein;

a magnetron on a lower part of an outside of the inner case;

a transformer for regulating a voltage provided to the magnetron;

a waveguide on an underside of the bottom plate;

a fan in a rear of outside of the inner case; and a flow guide for guiding air passed through the magnetron toward the air outlet holes.

2. The commercial microwave oven as claimed in claim 1, wherein the bottom plate has an opening adjacent to the air outlet holes.

3. The commercial microwave oven as claimed in claim 1, wherein the flow guide is provided between the magnetron and the air outlet holes.

4. The commercial microwave oven as claimed in claim 3, wherein the flow guide is formed of a thin plate having a lower part the more bent forward with a slope as it goes down the farther.

5. The commercial microwave oven as claimed in claim 1, wherein the main cabinet includes;

an outer case forming a top and sides of the microwave oven, a front panel on a front part of the outer case, and a rear panel on a rear part of the outer case having air inlets.

6. The commercial microwave oven as claimed in claim 1, wherein the waveguide has one end in communication with a bottom of the inner case, and the other end in communication with the magnetron.

7. The commercial microwave oven as claimed in claim 1, further comprising a supporting frame having a bottom part fixed to the base frame, and a top part the transformer is mounted thereon.

8. The commercial microwave oven as claimed in claim 7, wherein the fan has a central part mounted at a height in the middle of a height of the magnetron and a height of the transformer.

9. The commercial microwave oven as claimed in claim 1, wherein the inner case has inlet holes in a side surface adjacent to the magnetron.

10. The commercial microwave oven as claimed in claim 1, wherein the fan is an axial fan.

* * * * *